US009181709B2

(12) United States Patent
Amendolea

(10) Patent No.: US 9,181,709 B2
(45) Date of Patent: Nov. 10, 2015

(54) RAPIDLY MOUNTED, MODULAR, UNIVERSAL GRAB BAR AND HANDRAIL SYSTEM

(76) Inventor: Rick Amendolea, Canfield, OH (US)

( * ) Notice: Subject to any disclaimer, the term of this patent is extended or adjusted under 35 U.S.C. 154(b) by 269 days.

(21) Appl. No.: 13/537,427

(22) Filed: Jun. 29, 2012

(65) Prior Publication Data

US 2013/0167454 A1 Jul. 4, 2013

Related U.S. Application Data

(60) Provisional application No. 61/502,554, filed on Jun. 29, 2011.

(51) Int. Cl.
*E04F 11/18* (2006.01)

(52) U.S. Cl.
CPC ..... *E04F 11/1802* (2013.01); *E04F 11/1804* (2013.01)

(58) Field of Classification Search
CPC ... E04F 11/18; E04F 11/1802; E04F 11/1804; E04F 11/181; E04F 11/1812; E04F 11/1817; E04F 11/1836; E04F 11/1838
USPC ..... 256/59, 65.01, 65.16
See application file for complete search history.

(56) References Cited

U.S. PATENT DOCUMENTS

| | | | | |
|---|---|---|---|---|
| 809,670 | A | 1/1906 | Covert | |
| 2,807,834 | A | 10/1957 | Blum | |
| 2,834,621 | A * | 5/1958 | Schroer | 256/65.07 |
| 2,886,278 | A | 5/1959 | Opie | |
| 2,999,671 | A * | 9/1961 | Blayden | 256/65.06 |
| 3,076,636 | A * | 2/1963 | Blum | 256/69 |
| 3,223,371 | A | 12/1965 | Miller | |
| 3,306,641 | A | 2/1967 | Blum | |
| 3,343,811 | A | 9/1967 | Kusel et al. | |
| 3,433,460 | A * | 3/1969 | Kusel et al. | 256/65.16 |
| 3,441,253 | A * | 4/1969 | Blum et al. | 256/70 |
| 4,650,164 | A | 3/1987 | Shepherd | |
| 6,270,058 | B1 | 8/2001 | Williams et al. | |
| 6,290,213 | B1 * | 9/2001 | Laird et al. | 256/65.05 |
| 6,508,458 | B1 | 1/2003 | Bartlett et al. | |
| 6,932,328 | B2 | 8/2005 | Shreiner et al. | |
| 2008/0078904 | A1 * | 4/2008 | Trimble | 248/251 |
| 2011/0303811 | A1 * | 12/2011 | Nash | 248/222.14 |

FOREIGN PATENT DOCUMENTS

| | | | | |
|---|---|---|---|---|
| EP | 1081309 A2 * | 3/2001 | | E04F 11/18 |
| GB | 2185798 A * | 7/1987 | | F16B 7/18 |

* cited by examiner

*Primary Examiner* — Michael P Ferguson
(74) *Attorney, Agent, or Firm* — Blynn L. Shideler; Krisanne Shideler; BLK Law Group

(57) ABSTRACT

A rapidly mounted, modular, universal handrail and grab bar system is disclosed having a plurality of wall mounted supports; a plurality of fasteners securing the wall supports, wherein each support is initially rotationally adjustable about the fastener; at least one stock rail member forms the handrail member, wherein each rail member is received within wall support rail recesses, and wherein the central fastener extends perpendicular to the axis of the rail member; and at least one lateral fastening member to secure the rail member to the support. The rail members can form a pair of back to back mounted grab bars on opposed sides of a partition, wherein a plurality of the wall mounted supports are on each side of the partition.

14 Claims, 6 Drawing Sheets

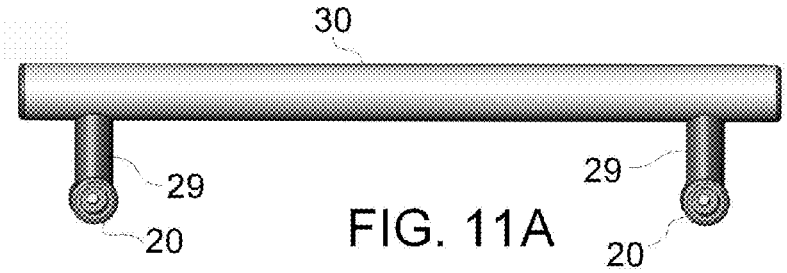
FIG. 11A
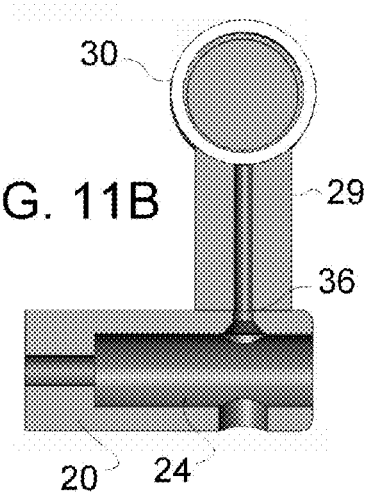
FIG. 11B
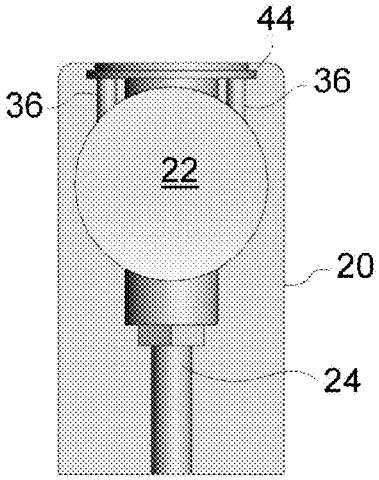
FIG. 13
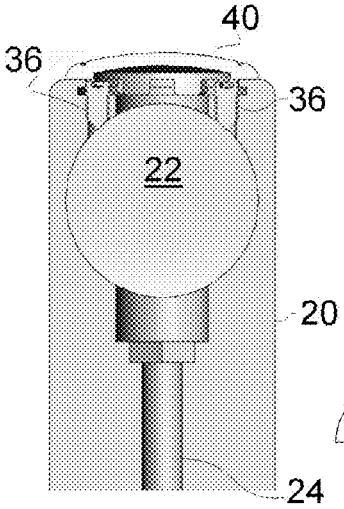
FIG. 14
FIG. 12
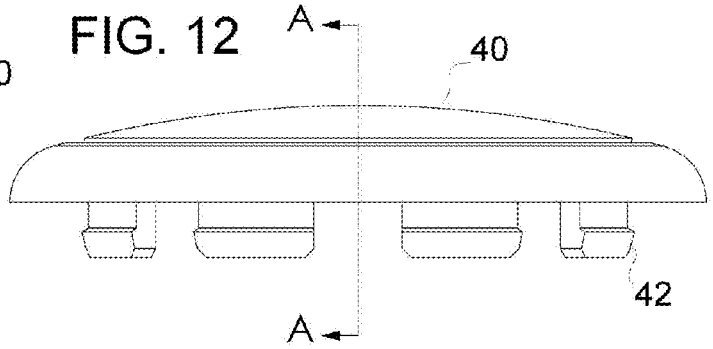

RAPIDLY MOUNTED, MODULAR, UNIVERSAL GRAB BAR AND HANDRAIL SYSTEM

RELATED APPLICATIONS

This application claims priority to U.S. patent application Ser. No. 61/502,554 filed Jun. 29, 2011, entitled "Rapidly Mounted, Modular, Universal Grab Bar and Handrail System."

BACKGROUND INFORMATION

1. Field of the Invention

The present invention relates to handrails and grab bars, and more particular to a rapidly mounted, modular, universal grab bar and handrail system.

2. Background Information

A handrail is a rail that is designed to be grasped by the hand so as to provide stability or support. Handrails are commonly used while ascending or descending stairways in order to prevent injurious falls. They can also be called banisters and balustrades. Handrails are typically supported by posts (or balusters) or mounted directly to walls. Other common handrail applications include handrails surrounding balconies.

A further common handrail application is forming a barre (also called a bar), which serve as training aids for ballet dancers. A barre is a stationary handrail that is used during ballet warm up exercises. The term also refers to the exercises that are performed at the barre, as well as that part of a ballet class that incorporates barre exercises.

A further common subset of handrails is known as grab bars. A grab bar is commonly identified as a bar forming a handhold which is designed to help people with disabilities. Grab bars are commonly found in accessible restrooms where they help people get in and out of wheelchairs and walkers. Grab bars can also be installed in full bathrooms to help people navigate the bathroom. In some homes, grab bars are installed in many locations around the house, anticipating a variety of potential needs. Although there is no precise limit or defining length, a grab bar is generally a shorter type hand rail. In fact in most applications a grab bar is a hand rail having only two supports.

There are a number of hand rail and grab bar systems illustrated in the prior art. For example U.S. Pat. No. 6,932,328 assigned to Constructions Specialties, Inc. discloses a rail and wall support installation includes an adapter which mechanically couples a wall support having a rotatable locking cam portion to an undercut groove on the rear of the rail. The adapter serves both as a mechanical attachment point for the rail to a wall support and to transfer the cam action of the locking cam portion to the rail. U.S. Pat. Nos. 6,508,458 and 6,270,058 also assigned to Constructions Specialties, Inc. discloses a similar systems.

U.S. Pat. No. 4,650,164 describes handrail system for suspending a handrail spaced from a supporting structure such as a wall with internal clamping brackets providing a trim appearance. The handrail system includes an elongated generally cylindrical rail body having a tubular wall of generally uniform wall thickness surrounding a hollow interior region. Slots are formed in the tubular wall along a line parallel with the rail axis. A rail support assembly connects each slot to the supporting structure. Each rail support structure includes a pair of similar stamped and formed metal brackets. Each bracket includes a flat body and an arm of reduced size extending from the body at an angle and defining a pair of rail engaging shoulders on the body. The arms are inserted through a slot into generally side-by-side relation within the hollow interior region with the shoulders extending beyond the slots. A threaded fastener engages the support structure and the brackets for clamping the bodies together and separating the arms to clamp the interior of the rail and hold the rail against the shoulders.

U.S. Pat. Nos. 3,433,360 and 3,343,811 disclose handrail mounting systems. Other relevant teachings can be found in U.S. Pat. Nos. 3,306,641, 3,223,371, 2,886,278, and 2,807,834.

Many currently available commercial grab bar products are configured with a flange mount that typically utilizes a two or three bolt-mounting pattern. When vertically mounted, these patterns provide for typically only one fastener, at best, on each end to align with a wall stud. If horizontally mounted, engaging a stud with a fastener is only possible if the length of the grab bar is such that it agrees with the spacing of the wall studs, and more often than not, the spacing does not agree. When anchoring to a wall stud is not possible, current grab bar manufacturers recommend using special fasteners such as a Wingits™ brand specialty fasteners and similar fasteners, or toggle bolts or the like. Wingits™ are very expensive and labor intensive. Toggle bolts are not as strong as anchoring to a stud. Consequently wall anchoring of the supports to a stud is preferred.

Thus, for optimum mounting strength, the length of the grab bar must match the spacing of the wall studs so that a fastener can be secured directly to a wall stud. Current commercial grab bar lengths are not adjustable or selectable. As noted above, many if not most of the available grab bar lengths do not agree with stud spacing. Installation is more involved, more time consuming, more labor intensive and more expensive when using special fasteners such as Wingits™ type fasteners, which are necessary when, anchoring to a wall stud is not possible.

Despite the plethora of handrail and grab bar systems developed there remains a need for a cost effective rapidly mounted, modular, universal grab bar and handrail system. There is a need for an easy and cost effective rapidly mounted, modular, universal grab bar and handrail system and easy back to back grab bar mounting.

SUMMARY OF THE INVENTION

One embodiment of this invention is directed to a rapidly mounted, modular, universal handrail and grab bar system. The system includes a plurality of wall mounted supports, wherein each wall support includes a rail member recess and is secured to the wall. The system includes a plurality of central fasteners, each central fastener with a drive head and associated with either one wall support, or two wall supports on opposed sides of the wall, for securing each wall support to the wall through the central fastener, wherein the mounted wall support is at least initially rotationally adjustable about the fastener. The system includes at least one stock rail member forming the handrail member, wherein each rail member is received within rail member recesses of the wall mounted supports and wherein the central fastener extends perpendicular to the axis of the rail member. The system includes a force transferring configuration comprising one of i) wherein each central fastener extends to a plane perpendicular to a longitudinal axis of the central fastener and including the axis of the rail member; or ii) wherein the rail member recess of each wall mounted support substantially encircles the rail members and are configured to align the rail member with the associated central fastener.

The system may optionally further includes at least one lateral fastening member, such as a set screw, received within at least one support used to secure the rail member to the support.

In an optional aspect of the present invention the each central fastener includes a conventional drive head in the form of an Allen-head or a hex-head. In a further optional aspect a fastener opening extends through each wall mounted support substantially perpendicular to the rail member recesses, and the system further includes fastener opening caps received in a front end of each wall mounted support in the fastener opening. A further optional aspect of the invention includes rail end caps on opposed ends of the rail member. A further optional aspect of the invention provides that at least some of the central fasteners are rear mounted to an associated wall support.

One optional aspect of the invention provides a plurality of axially aligned rail members with the system further including a coupling member connecting axially adjacent ends of adjacent rail members.

One embodiment of this invention is directed to a pair of back to back mounted grab bars on opposed sides of a partition. The grab bars comprise a plurality of wall mounted supports on each side of the partition, wherein each wall mounted support is secured to the partition in alignment with a wall support on an opposed side of the partition. The grab bars comprise a plurality of central fasteners, each central fastener with a drive head and associated with one pair of aligned wall supports for securing the wall supports to the partition by the central fastener, wherein each mounted wall support is initially rotationally adjustable about the fastener. The grab bars comprise a pair of stock rail members forming the handrail members of the pair of grab bars on opposed sides of the partition, wherein each rail member is received within rail member recesses in the wall supports on one side of the partition.

The present invention provides a grab bar and hand rail system that can be substantially mounted to a typically constructed residential and/or commercial wall or partition in any attitude (horizontal, vertical or at any angle) regardless of the wall construction. The system provides the capability to be mountable from the front, rear and back to back, and wherein the grab bar system should be mountable without the use of specialized fasteners or attachment devices.

It is noted that, as used in this specification and the appended claims, the singular forms "a," "an," and "the" include plural referents unless expressly and unequivocally limited to one referent.

The features that characterize the present invention are pointed out with particularity in the claims which are part of this disclosure. These and other features of the invention, its operating advantages and the specific objects obtained by its use will be more fully understood from the following detailed description and the operating examples.

BRIEF DESCRIPTION OF THE FIGURES

The invention is illustrated by way of example, and not by way of limitation in the figures of the accompanying drawings in which like reference numerals refer to similar elements.

FIG. 11A is a schematic front elevation view of a front mounted, modular, universal grab bar system according to one aspect of the present invention;

FIG. 11B is a cross sectional view of front mounted, modular, universal grab bar system of FIG. 11A;

FIG. 12 is a side elevation view of an alternative wall support end cap for the rapidly mounted, modular, universal grab bar and hand rail systems of FIG. 13;

FIG. 13 is a schematic sectional view of a wall support for the rapidly mounted, modular, universal hand rail and grab bar systems of FIGS. 1-2; and FIG. 14 is a schematic sectional view of the wall support of FIG. 13 and cap of FIG. 12 with set screws for the rapidly mounted, modular, universal hand rail and grab bar systems of FIGS. 1-2.

DESCRIPTION OF THE PREFERRED EMBODIMENTS

The present invention can easily be described in connection with the front mounted, modular, universal hand rail and grab bar system 10 shown in FIGS. 1A and 1B that is mounted to a wall having a front wall board 12 (shown in phantom) mounted on studs 14. The rear wall board 12 will often form the front wall board of an adjacent room as known in the art. As noted above a grab bar is generally a shorter sub-set of hand rails, however there is no precise limit as to length so the terms are generally interchangeable herein. The system can be used as a stairwell railing as shown in FIGS. 2A and 2B.

Figure 4A:
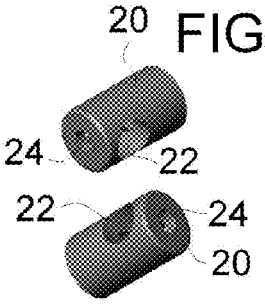
FIG. 4A is a perspective view of a pair of wall support for the rapidly mounted, modular, universal hand rail and grab bar systems of FIGS. 1-2.
Figure 4B:
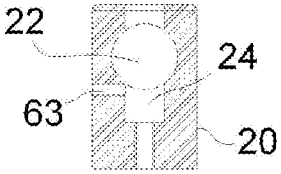
FIG. 4B is a sectional view of one wall support of FIG. 3.
Figure 6:
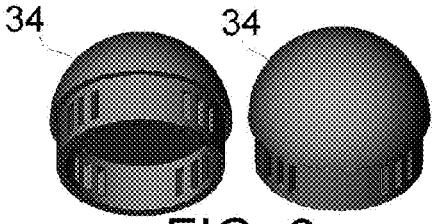
FIG. 6 is a perspective view of a pair of rail member end caps for the rapidly mounted, modular, universal hand rail and grab bar systems of FIGS. 1-2.

The system 10 includes a plurality of wall mounted supports 20 shown in greater detail in FIGS. 4A and 4B with an alternative shown in FIGS. 13-14. Each wall support 20 can be easily formed of plastic, metal, or other material of suitable strength, and can include any ornamental outer configuration and finish as desired. The circular cross section shown for the wall supports 20 is believed to be the easiest from a manufacturing standpoint. Each wall mounted support 20 includes a rail member recess 22 extending generally perpendicular to a longitudinal axis of the wall support 20. In the embodiments of FIGS. 4*a-b* and FIGS. 13-14 the rail member recess 22 is in the form of a rail member encircling opening and is aligned with a central fastener opening 24 that extends generally along the longitudinal axis of the wall support.

Figure 1A:
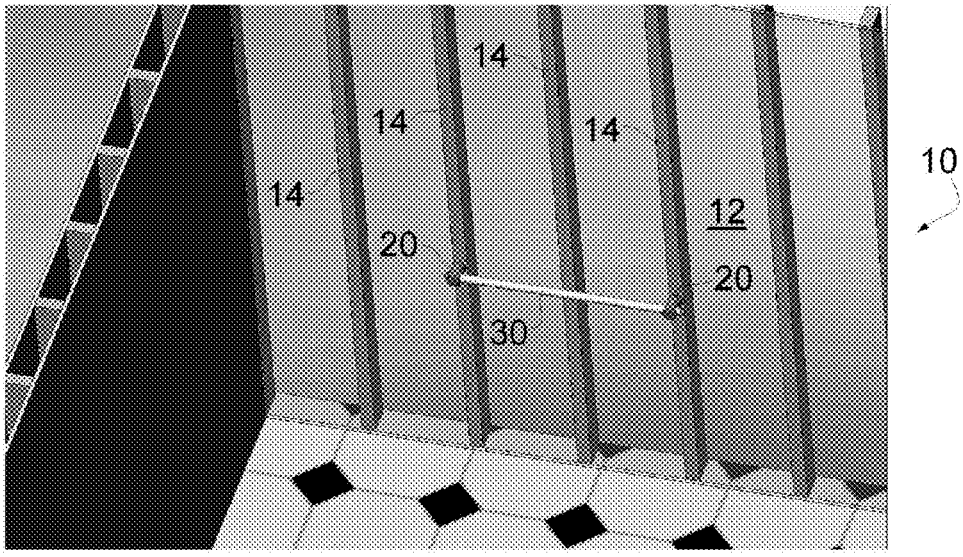
FIG. 1A is a schematic perspective view of a front mounted, modular, universal hand rail and grab bar system according to one aspect of the present invention with the front wall board shown in phantom for clarity.
Figure 1B:
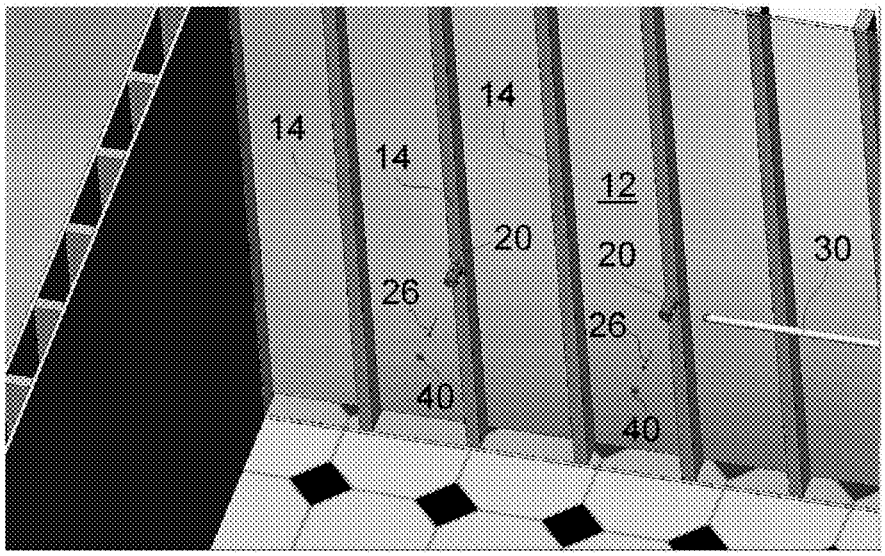
FIG. 1B is an exploded view of the front mounted, modular, universal hand rail and grab bar system according to FIG. 1A.
Figure 2A:
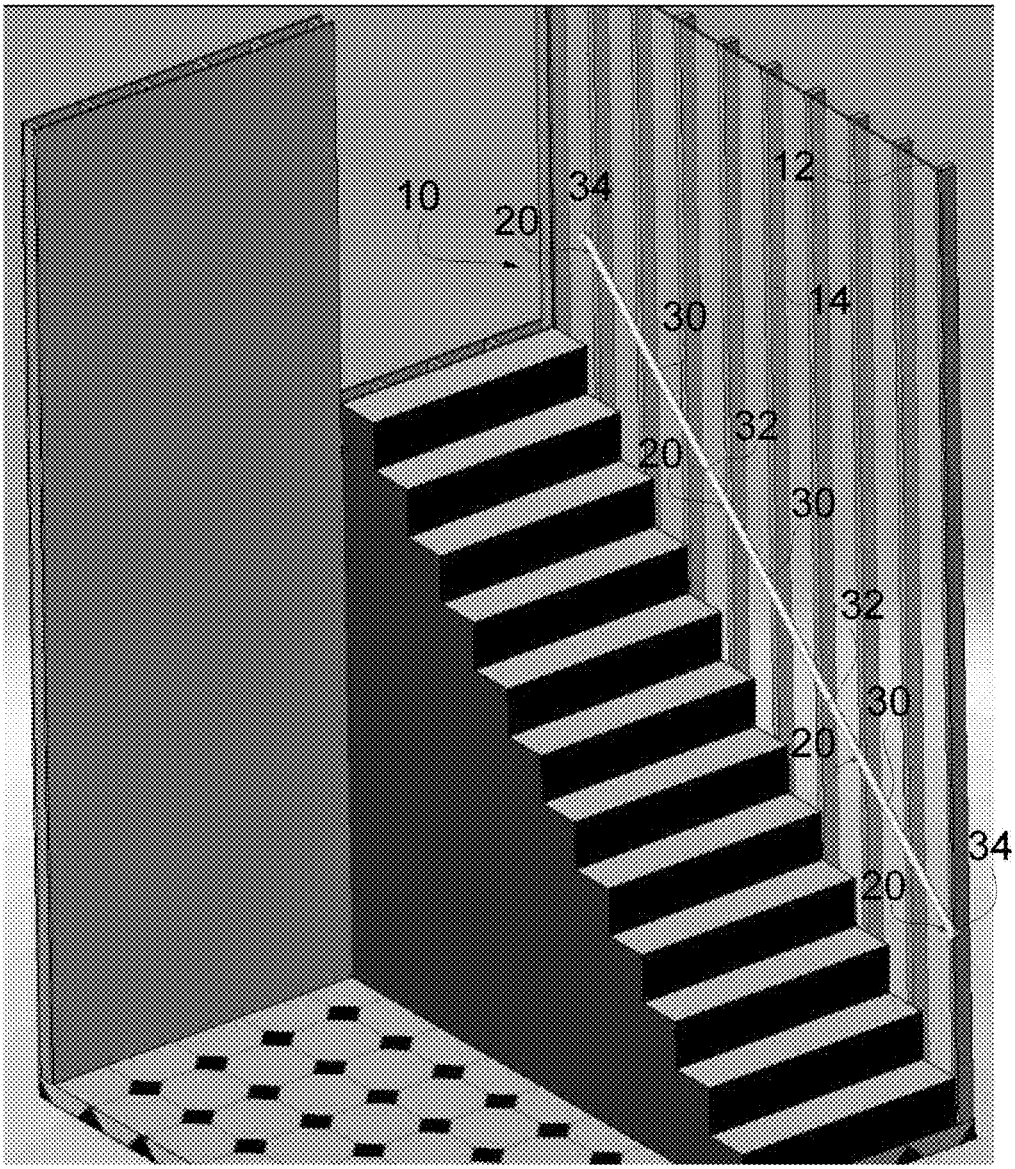
FIG. 2A is a schematic perspective view of a front mounted, modular, universal hand rail and grab bar system used as a stairwell railing according to one aspect of the present invention.
Figure 2B:
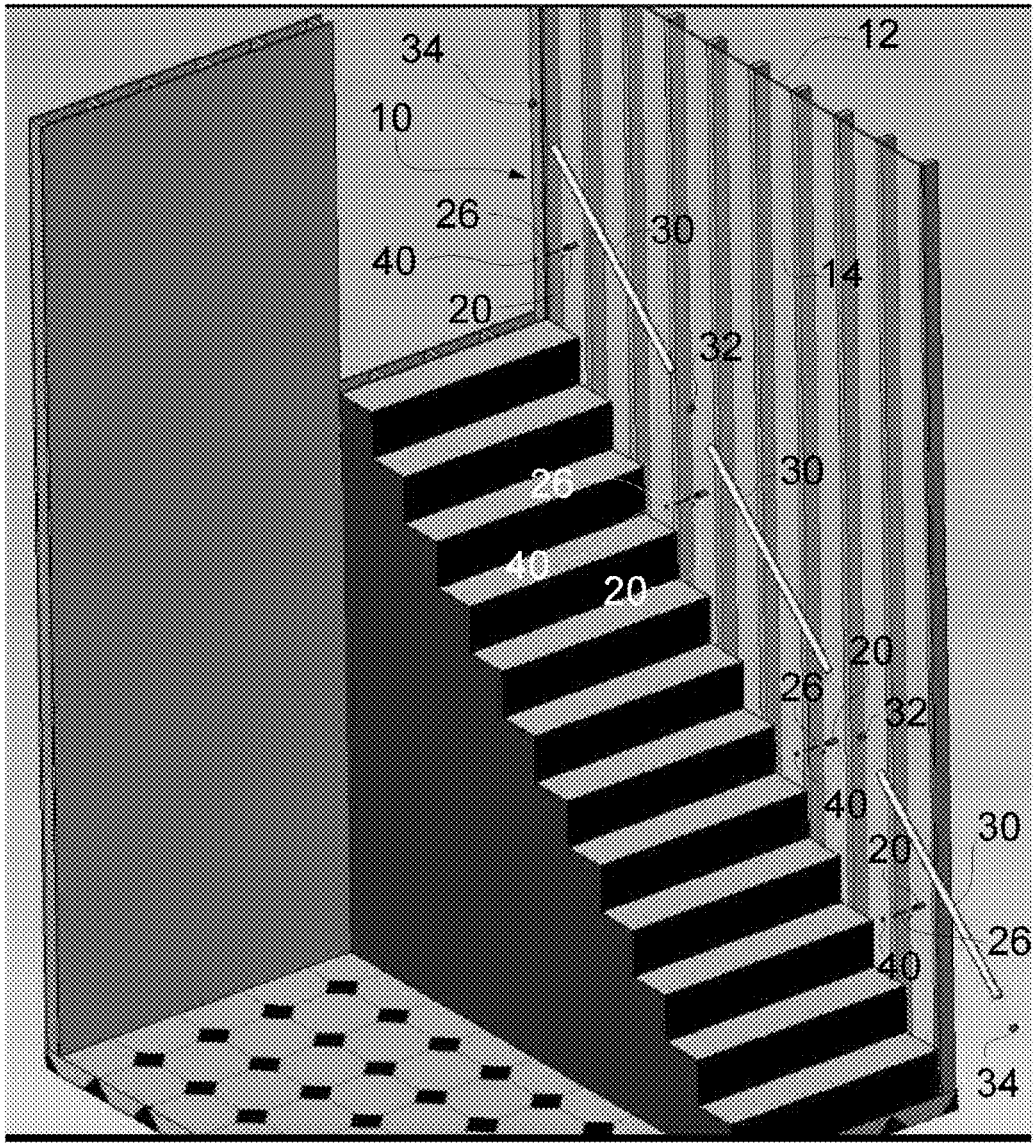
FIG. 2B is an exploded view of the front mounted, modular, universal hand rail and grab bar system according to FIG. 2A.

The central fastener opening 24 is stepped to allow for receipt and rotation of the head of a central faster 26 shown in FIGS. 1B and 2B. It is anticipated that a portion of the opening 24 (below the recess 22) may be formed to conform to a larger locking nut fastener as a built in anti-rotation mechanism for ease of assembly of back to back coupling as in FIG. 3. For example a portion of the opening 24 may be a hexagonal shape to receive a matching nut in a non-rotational manner. The hexagonal shaped portion, if provided, of the opening 24 should be large enough to allow for free rotation of the head of central fastener 26 when the wall support 20 is used in front mounting applications as in FIGS. 1A and B and 2A and B or as the front side wall support of back to back applications as in FIG. 3. Finally the lower portion of the opening 24 may be threaded to accommodate rear mounting or back to back mounting possibilities.

As shown in FIGS. 1A and 1B and 2A and B, each wall support 20 is secured to a wall stud 14 with a fastener 26, wherein each central fastener 26 includes a drive head and is associated with a wall mounted support 20 for securing each wall mounted support 20 to the wall through the central fastener 26. The central fastener may be any number of conventional fasteners, such as a steel fastener with a hex or Allen head drive head and a wood engaging end for use with the wood studs 14 of the walls of FIGS. 1A and 1B. A fastener 26 with an expanding toggle would be appropriate for metal studs (commonly found in commercial applications) which are typically a "C" channel shape. As described below the fastener 26 may threadingly engage a nut within an opposed wall support 20 for back to back attachments such as FIG. 2 and/or the fastener 26 may engage the threads of the lower end of the opposed wall support 20. Each wall mounted support 20 is, at least at time of initial wall attachment, rotationally adjustable about the central fastener 26 to allow for proper alignment with other laterally spaced wall supports 26.

Figure 5:
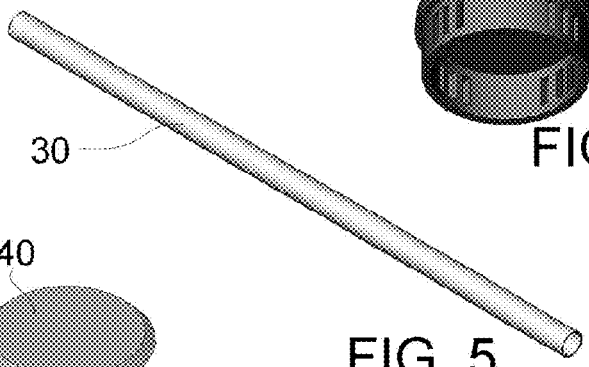
FIG. 5 is a perspective view of a hand rail member for the rapidly mounted, modular, universal grab bar and hand rail systems of FIGS. 1-2.

The system 10 includes at least one stock rail member 30, shown individually in FIG. 5, forming the handrail member or grab bar, wherein each rail member 30 is received within rail member recesses 22 of the wall mounted supports 20. The central fastener 26 of each wall support 20 extends perpendicular to the axis of the rail member 30. The stock rail member 30 can be easily formed of common metal bar stock which can be easily cut to length by the user for a designated length. The rail member 30 can have numerous decorative finishes as desired (such as a knurled surface for improved grip) and the material selection is dependent only upon the strength requirements for the grab bar or handrail. The rail member 30 is shown used with two supports 20, but three or more wall supports 20 could be implemented with a single section or piece of rail member 30.

Figure 10:
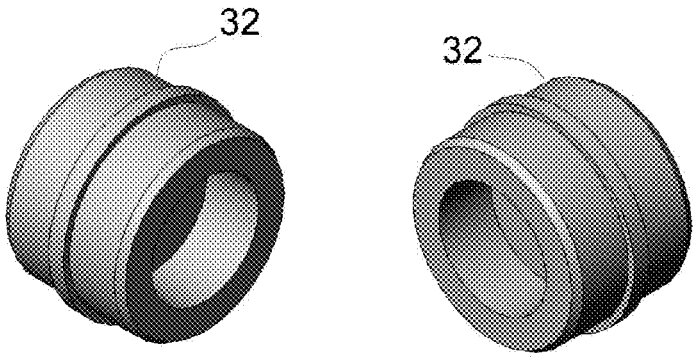
FIG. 10 is a perspective view of a pair of rail member couplers for the rapidly mounted, modular, universal hand rail systems of FIGS. 1-2.

The use of coupler 32, shown individually in FIG. 10, can be used to connect two adjacent axially aligned sections of rail member 30 as shown in FIGS. 2A and 2B, to continue a hand rail as desired for any effective length, such as may be useful in forming a barre. Angled couplers 32 can be used to accommodate changes in the angle of a continuous railing, such as a 90 degree bend in the interior of a room where the railing is to be continuous around that corner of the room. Similarly a lesser angle coupler would be appropriate for transitions from landings to stairs. The coupler 32 has a shape that includes opposed ends received within and having a diameter matching the inner diameter of each associated rail member 30 and a central portion having an outer diameter matching the outer diameter of the rail members 30.

Rail member end caps 34 can be used at distal ends of the grab bar or rail member 30. The end caps 34 can take a variety of decorative shapes. The wall supports 20 include at least one screw hole 36 for receipt of a set screw (or set screws) there through to engage with the hand rail member 30 to rotationally and axially secure the hand rail member 30 in position. The wall support 20 of FIGS. 13-14 include a pair of set screw holes 36 as shown and have them positioned in the front of the wall support for ease of assembly and to have the set screw be covered by the cap 40, discussed below. Screws need not be at each wall support 20, as one screw per section of rail member 30 may be sufficient.

Figure 7:
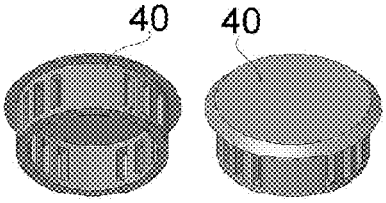
FIG. 7 is a perspective view of a pair of wall support end caps for the rapidly mounted, modular, universal grab bar and hand rail systems of FIGS. 1-2.

A central fastener end cap 40 is shown in FIG. 7 is provided for sealing the opening 24 of the wall supports. FIG. 12 illustrates a further end cap 40 design having an annular array of fingers with locking projections 42 that engage an associated undercut 44 in the wall support 20 shown in FIGS. 13 and 14. The cap design 40 of FIG. 12 shows one particular secure snap fit coupling that can be utilized to attach the end cap 40 to the wall support 20. Other known snap fit or other connections could be implemented. The caps 40 and 34, and couplers 32, can easily be formed of plastic, but any number of materials and decorative finishes are possible. The cap 40 with the locking projections 42 of FIG. 12 when used with the wall support 20 of FIGS. 13 and 14 covers the fastener and the set screws such that there are no exposed fasteners providing for a tamperproof construction that is advantageous particularly in commercial applications.

Figure 3:
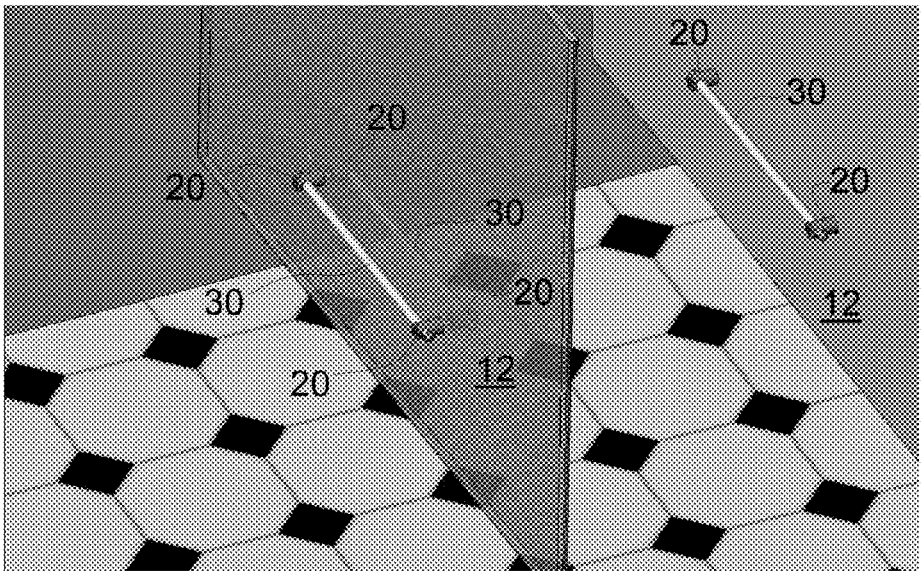
FIG. 3 is a schematic perspective view of a back to back mounted, modular, universal grab bar system according to one aspect of the present invention.

A force transferring configuration is found in the design shown in FIGS. 1A and B and FIG. 3 wherein the rail member recess 22 of each wall mounted support 20 encircles the rail members 30 and are configured to align the rail members 30 with the associated central fastener 26. This design provides an efficient load transfer (in use) from the rail member 30 to the support 20 to the fastener 26.

Figure 8:
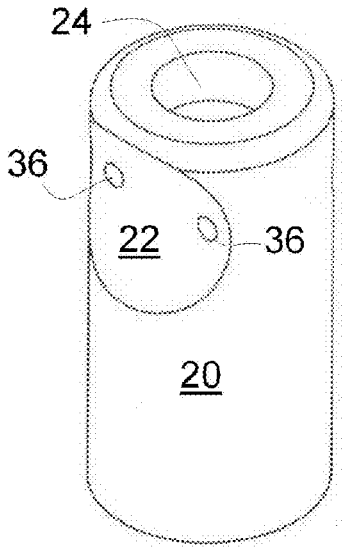
FIG. 8 is a perspective view of a modified wall support for the rapidly mounted, modular, universal grab bar and hand rail systems of FIGS. 1-2.
Figure 9:
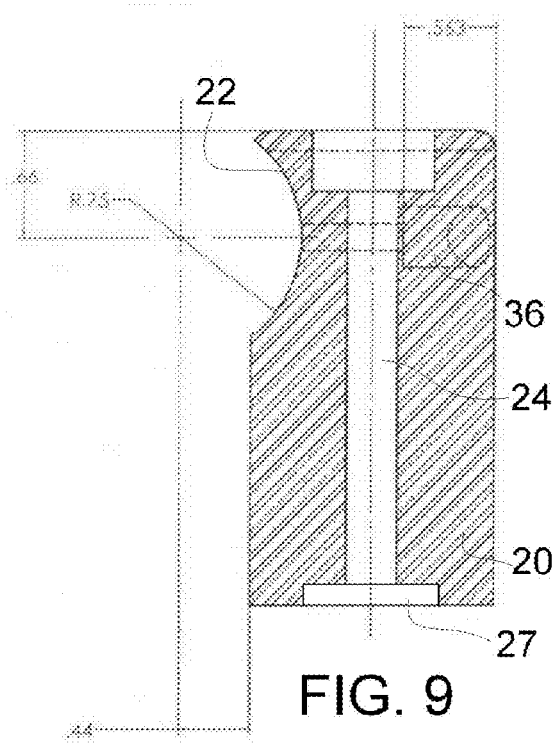
FIG. 9 is a sectional view of the modified wall support of FIG. 8.

An alternative design with alternative force transferring features is shown in FIGS. 8-9 and in the embodiment of FIGS. 11A and B. In these embodiments the recess 22 is not aligned with the fastener opening 24 and is on top of the support 20. In the embodiment of FIGS. 11A and B the recess 22 receives a standoff 29 that is coupled to the member 30 to raise the bar member a desired amount. The top mounting of the rail member 30 in embodiments of FIGS. 8-9 and 11A and B allows for less interruption with the top surface of the hand rail member 30, such as is often desired when designing or implementing a stair railing as shown in FIGS. 2A and B.

In the embodiment of FIGS. 8-9 the load transfer configuration provides that each central fastener 26 extends to a plane perpendicular to a longitudinal axis of the central fastener 26 and including the axis of the rail member 30. The central opening 24 is designed to assure this positioning of the central fastener 26 in both front and rear attaching applications. Essentially the head of the fastener 26, or a locking nut for back-to-back applications is farther back as shown, than in the designs of FIGS. 4A and B. In both of these configurations of wall supports 20 the "failure mode" when in use will typically be through a bending of the fastener 26 rather than a pulling out of the fastener from the wall (which is considered a more catastrophic failure for a hand rail or grab bar often causing a fall and potential serious injury to the user). It seems doubly tragic where a hand rail would cause the very injury it was designed to prevent. The present system has been designed to minimize failure and to provide a failure mode (as all parts will eventually fail) that is less traumatic.

The design of FIGS. 8-9 also shows two set screws 36 which would typically be tapped into the rail members 30 for secure engagement and have an enlarged head to resist upward forces on the hand rail member 30.

The invention provides for front side mounting, rear side mounting and back to back mounting of grab bars or hand rails of a single bar or multi bar lengths.

Front-Side Mounting

With front mounting shown generally in FIGS. 1A and 1B and FIGS. 2A and B, each wall support 20 is fastened with a single centralized fastener 26 (in this example fastener 26 may be a standard woodscrew fastener) from the front through the wallboard 12 or the like and into a stud 14. As noted above, the wall support 20 has a rail member recess 22 in the form of a through hole, perpendicular to its axis, with a diameter sufficient for the hand rail member 30 to pass through.

Each of the two (or more) wall supports 20 can be located on a stud 14 regardless of the stud spacing. A fastener 26 is inserted through the front end of the fastener opening 22 of each wall support 20, and engaged into the wall and stud 14. Typically the fastener can be driven directly into the wooden stud 14 with no pre-drilling required. A separate conventional metal stud fastener 26 would be utilized for metal stud containing walls.

The required length of hand rail member 30 can be measured, based on the distance between the wall supports 20 and the desired overhang, and the stock material for the member 30 then cut to length. The cut member 30 is inserted through both (or more) wall supports 20 and secured with a set screw fastener 36 in one or more wall supports 20. Where plural sections of member 30 are needed, as in FIGS. 2A and 2B, they can be coupled together with coupler 32 and only the last or end section of member 30 cut to length.

Rear-Side Mounting

With rear mounting as shown in one side of FIG. 3, such as for a grab bar on one side of a thin partition wall 12, each wall support 20 is fastened with a single centralized fastener 26 (in this case a standard machine screw or hex bolt), that enters from the back through the appropriate wall material (e.g., partition) and threads into a nut in the wall support 20, or directly into a threaded lower end of the wall support 20. The advantage of back side mounting is that the fastener 26 is received within the wall support 20 rather than obtrusively than possibly extending out one side of the partition, or not extending far enough if a front mount was selected for the thin walled partition application.

Like the front mounting, each of the two (or more) wall supports 20 can be located on the partition wall and the required length of rail member 30 can be measured, based on the distance between the wall supports 20, and cut to length. The cut member 30 is inserted through both (or more) wall supports 20 in the recess 22 (or on the wall support recess 22 for the alternative support 20 design) and secured with a single or multiple set screw fastener 36.

Back to Back Mounting

With back to back mounting as also represented in FIG. 3, two wall supports 20 are fastened in line on either side of a wall partition or the like with a single centralized fastener 26 and nut (typically a standard hex bolt and nut). Like the front and rear mounting techniques, each of the two (or more) wall supports 20 can be located on the partition wall (at any angle relative to each other) and the required length of member 30 can be measured, based on the distance between the wall supports 20, and cut to length. The cut member 30 is inserted through both (or more) wall supports 30 and secured with one or more set screw fasteners 36. Further, to assist in a one person application, a retaining washer can be place on the back side as the fasteners 26 are first placed through to the "back side" to prevent the fasteners 26 from easily being pushed back through during installation. The bottom of fastener hole 24 may be provided with an enlarged circular or hexagonal recess 27 to receive a nut and/or such a retaining or lock washer, if used, and still provide flush wall mounting. The hexagonal recess 27 can prevent the locking nut from turning to assist one person application.

For long grab bar lengths, and handrail installations, or additional rigidity, multiple wall supports 20 can be used and positioned as required. Rail member 30 lengths can be increased by using a coupler 32 to join the aligned rail member sections together as demonstrated in FIGS. 2A and 2B.

The present invention provides a simple to install hand rail system that can be adjusted for any length and wall stud spacing and for any desired angle. The ease of cutting the bar stock to length minimized the number of components an installer must carry for any job. The single point fastening provides for rapid attachment of the system and for easy angular adjustment of a wall support relative to an adjacent support. The present system provides that accurately holding the mounting distance between wall supports is not required since the supports are separate loose pieces that are individually mounted. The present system does not require a multiple-fastener mounting pattern is not necessary (typical grab bars have 3 fasteners per end-6 total). Further the system can be easily implemented with hex head fasteners and hex head fasteners can be installed with a drive socket rather than a screw driver. It's physically much easier to install a fastener with a ratchet socket wrench than a screwdriver. With hex head fasteners, much higher tightening torque can be achieved which results in greater holding force. Front mounting, rear mounting and back to back mounting configurations are all easily provided for without special tools or fasteners.

The system provides a single versatile, product that's simple to install and the finished installation are esthetically pleasing. Further the system provides for no exposed fasteners. The system provides for unlimited lengths are possible by simply connecting bars together. The system provides for significant reduction in installation labor with single point fastening. The system provides for unrestricted mounting capabilities (horizontal, vertical, at any angle). The system preferably utilizes stock rail members cut to length and inexpensive standard fasteners instead of high cost specialty fasteners.

It will be apparent to those of ordinary skill in the art that various modifications may be made to the present invention without departing from the spirit and scope thereof. The scope of the invention is not to be limited by the illustrative examples described above.

What is claimed is:

1. A rapidly mounted, modular, universal handrail and grab bar system comprising:

a plurality of wall mounted supports, wherein each wall mounted support is formed as a one piece cylindrical member having a wall end configured to be adjacent a wall with a central fastener opening extending along a longitudinal axis of the cylindrical member from the wall end through to a distal end and wherein the one piece member forming the wall mounted support includes a rail member recess formed as a through-hole extending through the longitudinal axis from one side of the wall mounted support through to an opposed side of the wall mounted support and intersecting with the central fastener opening and wherein each wall mounted support is configured to be secured to a wall, and wherein the central fastener opening is formed as a first bore extending from the wall end to an enlarged head receiving portion having a diameter larger than a diameter of the first bore extending to the distal end, wherein the enlarged head receiving portion is accessible through the distal end of the wall mounted support and wherein the intersection of the enlarged head receiving portion with the first bore is at least one half of the distance of from the wall end to the through-hole forming the rail member recess;

a plurality of central fasteners, each central fastener with a drive head and associated with at least one wall mounted support and received within the central fastener opening thereof for securing each wall mounted support to the wall through the central fastener, wherein the central fastener is configured to be accessed through the distal end of the wall mounted support, wherein the wall mounted support is, at least at one time, rotationally adjustable about the central fastener, and wherein the one piece wall mounted support is substantially solid surrounding the central fastener opening from the one end to the through-hole forming the rail member recess; and at least one stock rail member forming the handrail member, wherein each rail member is received within rail member recesses of the wall mounted supports extending entirely through the through-hole forming the rail member recess and wherein the central fastener extends perpendicular to the axis of the rail member, wherein the rail member recess of each wall mounted support is formed as a through-hole whereby the recess substantially encircles the rail member which is received within rail member recess and aligns the rail member which is received within rail member recess with the associated central fastener which is received within the central fastener opening.

2. The rapidly mounted, modular, universal handrail and grab bar system of claim 1 further including at least one lateral fastening member received within at least one wall mounted support used to secure the rail member to the wall mounted support.

3. The rapidly mounted, modular, universal handrail and grab bar system of claim 1 wherein each central fastener includes a conventional drive head in the form of an Allen-head or a hex-head.

4. The rapidly mounted, modular, universal handrail and grab bar system of claim 1 further including a fastener opening extending through each wall mounted support substantially perpendicular to the rail member recesses; and fastener opening caps received in a front end of each wall mounted support in the fastener opening.

5. The rapidly mounted, modular, universal handrail and grab bar system of claim 1 further including rail end caps on opposed ends of the rail member.

6. The rapidly mounted, modular, universal handrail and grab bar system of claim 1 wherein the rail members form a pair of back to back mounted grab bars on opposed sides of a partition which forms the wall.

7. The rapidly mounted, modular, universal handrail and grab bar system of claim 6 wherein a plurality of the wall mounted supports are on each side of the partition, wherein each wall mounted support is secured to the partition in alignment with a wall mounted support on an opposed side of the partition.

8. The rapidly mounted, modular, universal handrail and grab bar system of claim 7 wherein each central fastener is associated with one pair of aligned wall mounted supports for securing the pair of wall mounted supports to the partition by the central fastener.

9. The rapidly mounted, modular, universal handrail and grab bar system of claim 6 wherein a pair of stock rail members form the handrail members of the pair of grab bars on opposed sides of the partition.

10. The rapidly mounted, modular, universal handrail and grab bar system of claim 1 wherein at least some of the central fasteners are rear mounted to an associated wall support.

11. A pair of back to back mounted grab bars on opposed sides of a partition, the grab bars comprising:

a plurality of wall supports on each side of the partition, wherein each wall support is formed as a one piece cylindrical member having a wall end configured to be adjacent a partition with a central fastener opening extending along a longitudinal axis of the cylindrical member from the wall end through to a distal end and wherein the one piece member forming the wall support includes a rail member recess formed as a through-hole extending through the longitudinal axis from one side of the wall support through to an opposed side of the wall support and intersecting with the central fastener opening, and wherein the central fastener opening is formed as a first bore extending from the wall end to an enlarged head receiving portion extending to the distal end and having a diameter larger than a diameter of the first bore, wherein the enlarged head receiving portion is accessible through the distal end of the wall support and wherein the intersection of the enlarged head receiving portion with the first bore is at least one half of the distance of from the wall end to the through-hole forming the rail member recess, and wherein each wall support is secured to the partition in alignment with a wall support on an opposed side of the partition;

a plurality of central fasteners, each central fastener with a drive head and associated with one pair of aligned wall supports and received within the central fastener openings thereof for securing the wall supports to the partition by the central fastener, wherein the central fastener is configured to be accessed through the distal end of the wall support, and wherein each mounted wall support is, at least initially, rotationally adjustable about the central fastener, and wherein the one piece wall support is substantially solid surrounding the central fastener opening from the one end to the through-hole forming the rail member recess; and a pair of stock rail members forming handrail members of the pair of grab bars on opposed sides of the partition, wherein each rail member is received within the rail member recesses in the wall supports on one side of the partition extending entirely through the through-hole forming the rail member recess, and wherein each rail member recess is formed as a through-hole whereby the recess is formed as a rail member encircling opening which encircles the rail member and aligns the rail member with the associated central fastener which is received within the central fastener opening.

12. The pair of back to back mounted grab bars on opposed sides of a partition of claim 11 further including a fastener opening extending through each wall mounted support substantially perpendicular to the rail openings; and including fastener opening caps received in a front end of each wall mounted support in the fastener opening.

13. The pair of back to back mounted grab bars on opposed sides of a partition of claim 11 further including rail end caps on opposed ends of each rail member.

14. The pair of back to back mounted grab bars on opposed sides of a partition of claim 11 wherein the central fastener extends perpendicular to the axis of the rail members.

* * * * *